US009872594B2

(12) United States Patent
Shin et al.

(10) Patent No.: US 9,872,594 B2
(45) Date of Patent: Jan. 23, 2018

(54) CLEANING ROBOT HAVING IMPROVED DRIVING AND CLEANING ABILITY

(71) Applicant: YUJIN ROBOT CO., LTD., Seoul (KR)

(72) Inventors: Kyung Chul Shin, Seoul (KR); Seong Ju Park, Gunpo-si (KR); Min Chang, Seongnam-si (KR); Wan Geun Kim, Seoul (KR); Sang Hyun Kim, Buchen-si (KR); No Soo Lee, Incheon (KR)

( * ) Notice: Subject to any disclaimer, the term of this patent is extended or adjusted under 35 U.S.C. 154(b) by 0 days.

(21) Appl. No.: 15/363,717

(22) Filed: Nov. 29, 2016

(65) Prior Publication Data

US 2017/0071437 A1 Mar. 16, 2017

Related U.S. Application Data

(63) Continuation of application No. PCT/KR2015/005422, filed on May 29, 2015.

(30) Foreign Application Priority Data

May 30, 2014 (KR) ..... 10-2014-0066580

(51) Int. Cl.

| | |
|---|---|
| ***A47L 11/24*** | (2006.01) |
| ***A47L 11/33*** | (2006.01) |
| ***A47L 11/40*** | (2006.01) |
| ***A47L 9/16*** | (2006.01) |
| ***A47L 9/28*** | (2006.01) |

(52) U.S. Cl.

CPC ..... *A47L 11/4041* (2013.01); *A47L 9/16* (2013.01); *A47L 9/28* (2013.01); *A47L 11/24* (2013.01); *A47L 11/4011* (2013.01); *A47L 11/4013* (2013.01); *A47L 11/4044* (2013.01); *A47L 11/33* (2013.01); *A47L 11/40* (2013.01); *A47L 2201/04* (2013.01)

(58) Field of Classification Search

CPC .. A47L 11/4041; A47L 11/24; A47L 11/4013; A47L 11/33

USPC ..... 15/319, 339, 340.3

See application file for complete search history.

(56) References Cited

U.S. PATENT DOCUMENTS 2,101,133 A * 12/1937 Dilliard ..... A47L 11/33 15/41.1
3,460,188 A * 8/1969 Boyd ..... A47L 5/30 15/159.1
4,864,682 A * 9/1989 Bewley, Jr. ..... A47L 5/34 15/364
7,856,291 B2 12/2010 Jung (Continued)

FOREIGN PATENT DOCUMENTS

EP 1121889 A1 8/2001
EP 1752078 A1 2/2007

(Continued)

*Primary Examiner* — Michael Jennings
(74) *Attorney, Agent, or Firm* — Jongkook ParkX

(57) ABSTRACT

Disclosed is a cleaning robot having an improved driving and cleaning ability. The cleaning robot includes a dust collecting blade. A lower end of the dust collecting blade is bent in a direction opposite to the driving direction of the cleaning robot during operation of the cleaning robot, so that wobbling is not generated even though the ground surface on which the cleaning robot operates has bumps and gaps.

15 Claims, 3 Drawing Sheets

(56) References Cited

U.S. PATENT DOCUMENTS

| | | | | |
|---|---|---|---|---|
| 8,230,540 | B1 * | 7/2012 | Nelson | A47L 11/22 15/41.1 |
| 8,438,694 | B2 * | 5/2013 | Kim | A47L 7/02 15/319 |
| 2004/0034952 | A1 * | 2/2004 | Ho | A47L 11/22 15/48.1 |
| 2004/0187249 | A1 * | 9/2004 | Jones | A47L 5/30 15/319 |
| 2005/0217042 | A1 * | 10/2005 | Reindle | A47L 11/24 15/41.1 |
| 2005/0229340 | A1 * | 10/2005 | Sawalski | A47L 11/24 15/50.3 |
| 2007/0266508 | A1 * | 11/2007 | Jones | A47L 5/30 15/49.1 |
| 2008/0201895 | A1 * | 8/2008 | Kim | A47L 9/106 15/319 |
| 2009/0100630 | A1 * | 4/2009 | Kim | A47L 9/1463 15/319 |
| 2012/0096656 | A1 * | 4/2012 | Jung | A47L 9/0411 15/52.1 |
| 2012/0222224 | A1 * | 9/2012 | Yoon | A47L 11/33 15/52.1 |

FOREIGN PATENT DOCUMENTS

| | | | | |
|---|---|---|---|---|
| EP | 2449939 | A2 * | 5/2012 | A47L 11/33 |
| EP | 2689701 | A2 * | 1/2014 | A47L 11/4041 |
| JP | 2002125899 | A1 | 5/2002 | |
| JP | 2004261539 | A1 | 9/2004 | |
| KR | 10-1083395 | A1 | 11/2011 | |

* cited by examiner

[FIG. 1]
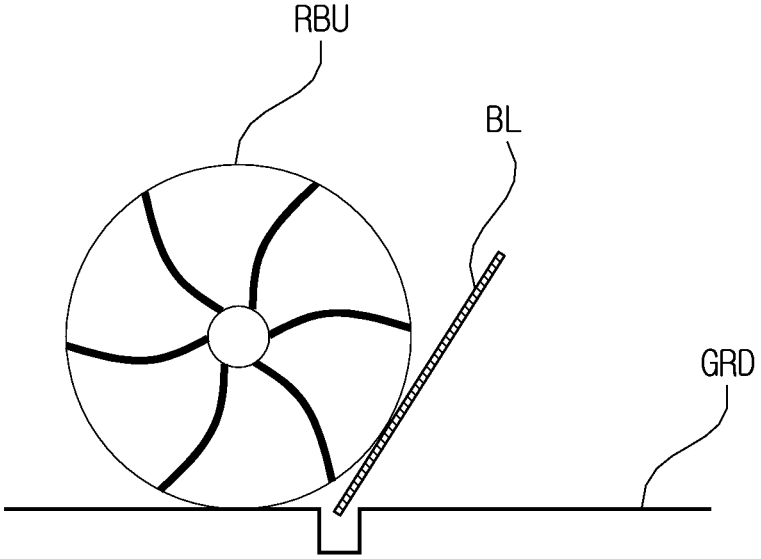
[FIG. 2]
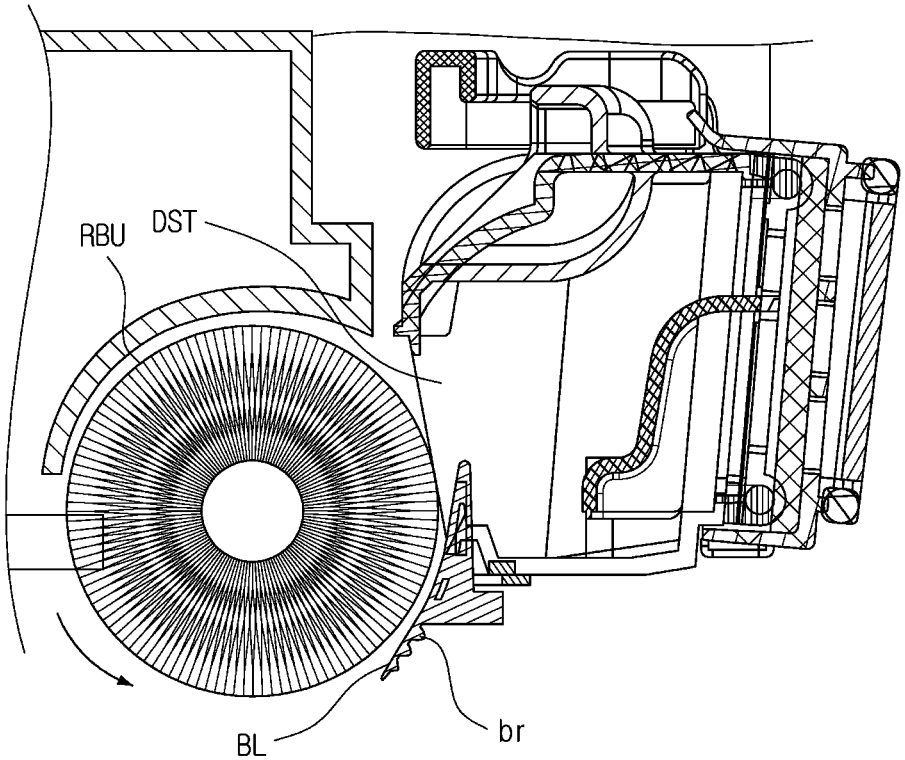

[FIG. 3A]
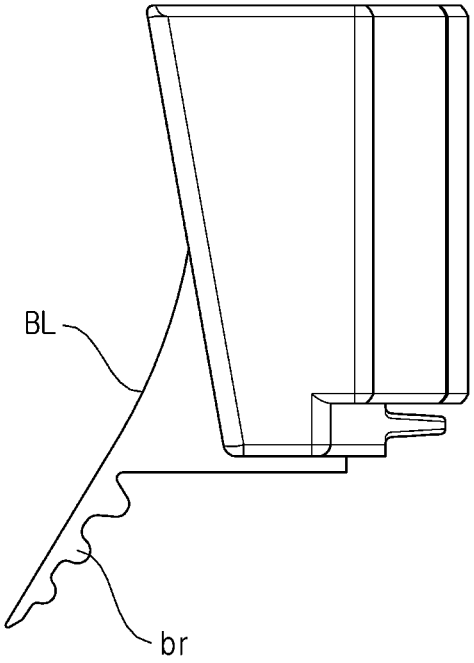
[FIG. 3B]
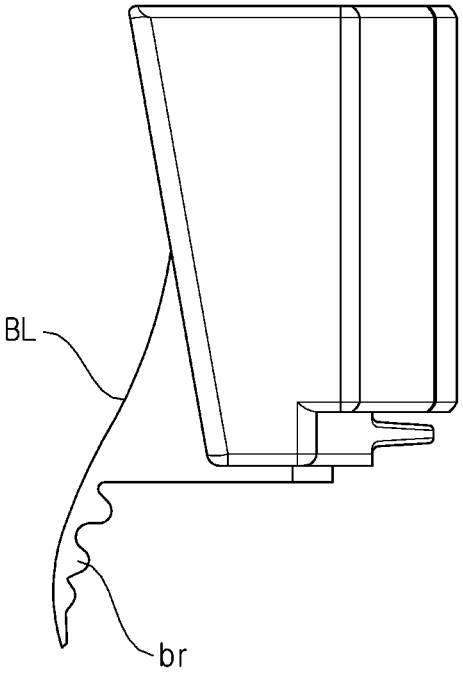

[FIG. 4]
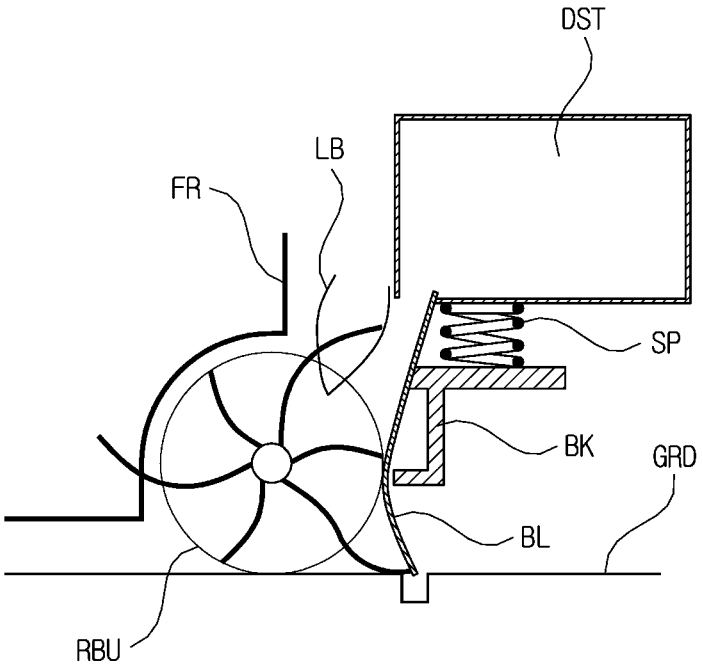
[FIG. 5]
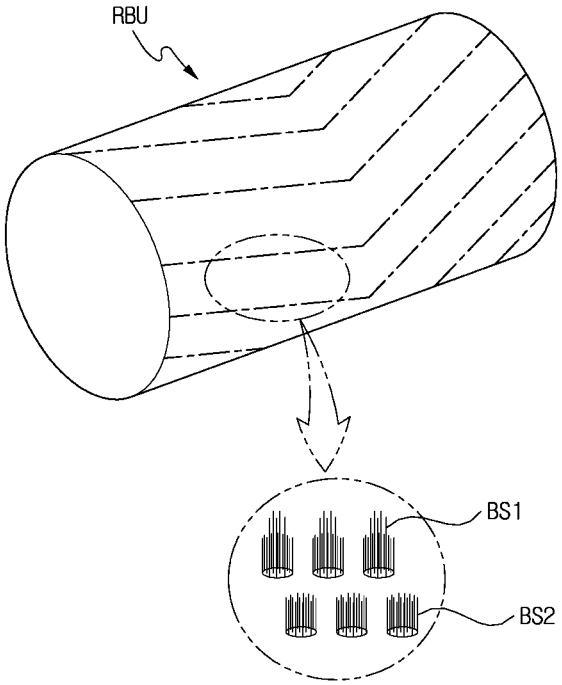

CLEANING ROBOT HAVING IMPROVED DRIVING AND CLEANING ABILITY

CROSS-REFERENCE TO RELATED APPLICATIONS

This application is a continuation of International Application No. PCT/KR2015/005422, filed on Mar. 29, 2015, which claims priority to and the benefit of Korean Patent Application No. 10-2014-0066580 filed in the Korean Intellectual Property Office on May 30, 2014, both of which are hereby incorporated by reference in their entireties.

TECHNICAL FIELD

The present invention relates to a cleaning robot, and more particularly, to a cleaning robot having an improved driving and cleaning ability.

BACKGROUND

In general, a robot refers to a mechanical device automatically performing a certain operation or manipulation. A robot is often used in place of a person in an industrial field or a medical field, or is used for performing a dangerous operation in a dangerous environment, in which it is difficult for a person to act. With the development of robotics technology, robots for use in the home have recently appeared in the marketplace. Representative of such home service robots is the cleaning robot.

Currently, a cleaning robot typically includes a rotary brush configured to rotate a plurality of brushes that sweep trash into a dust box and a dust collecting blade which guides dust and other debris collected by the rotary brushes to the dust box. A cleaning robot also typically includes various sensors and a navigation function that allow the robot to recognize its position within a home and recognize room boundaries such that it can thoroughly clean every nook and corner of a room and enable the robot to start and finish cleaning by itself without receiving a separate command from a user.

Efforts to improve the cleaning performance of a cleaning robot have been underway, and as a result of such efforts, more advanced cleaning robots have been developed.

The cleaning robot generally includes a rotary brush, which is configured to rotate a plurality of brushes to sweep trashes into a dust box, and a dust collecting blade, which guides dust and other debris collected by the rotary brushes to the dust box.

FIG. 1 illustrates an example of a structure of a rotary brush and a dust collecting blade of a conventional cleaning robot.

FIG. 1 is a schematic cross-sectional view illustrating the structure of a rotary brush RBU and a dust collecting blade BL of a conventional cleaning robot. As illustrated in FIG. 1, the dust collecting blade BL is disposed such that a lower part is angled towards a traveling direction of the cleaning robot, that is, towards the rotary brush RBU. Therefore, dust and other debris collected by the rotary brush RBU are easily collected in a dust box (not shown) provided above the dust collecting blade BL.

However, when the dust collecting blade BL is diagonally disposed as illustrated in FIG. 1, if the ground surface GRD is bumpy or there is a gap in the ground surface GRD, the bottom edge of the dust collecting blade BL can become repeatedly stuck as the cleaning robot moves over bumps or gaps on the ground surface GRD, thereby causing the cleaning robot to wobble. Such wobbling may cause unwanted noise and/or cause the cleaning robot to malfunction. Further, the lifespan of the cleaning robot may be shortened due to such frequent wobbling.

In order to avoid the above-mentioned problem, the dust collecting blade BL may be arranged such that there is a predetermined gap (for example, a 1 mm gap) between the bottom edge of the dust collecting blade BL and the ground surface GRD. However, when there is a gap between the bottom edge of the dust collecting blade BL and the ground surface GRD, dust and other debris collected by the rotary brush RBU may escape through the gap, thereby reducing the cleaning robot's effectiveness. Similarly, even when there is intentionally no gap between the bottom edge of the dust collecting blade BL and the ground surface GRD, over time, the bottom edge of the dust collecting blade BL may become worn by rubbing against the ground surface GRD, thereby creating a gap between the bottom edge of the dust collecting blade BL and the ground surface GRD, thereby reducing the cleaning robot's effectiveness.

FIG. 2 illustrates another example of a dust collecting blade of a conventional cleaning robot and FIGS. 3A and 3B illustrate an operation of the dust collecting blade of FIG. 2.

FIG. 2 illustrates a cleaning robot disclosed in Korean Registered Patent No. 10-1083395 (published on Nov. 14, 2011). As shown in FIG. 2, a dust collecting blade BL, comprising an elastic material, is provided at a rear side of a rotary brush RBU with respect to the traveling direction of the cleaning robot. Similar to the dust collecting blade BL of FIG. 1, the dust collecting blade BL of FIG. 2 is arranged such that its bottom edge is angled towards the direction of travel of the cleaning robot. However, the dust collecting blade BL of FIG. 2 is different from the dust collecting blade BL of FIG. 1 in that a plurality of bars br are formed on a rear surface of the dust collecting blade BL. These bars are disposed at predetermined intervals in a horizontal direction as shown in FIG. 2. In addition, the thickness of the dust collecting blade BL and the sizes of the plurality of bars br formed on the rear surface of the dust collecting blade BL are gradually reduced towards the bottom edge of the dust collecting blade BL as shown in FIG. 2.

Referring to FIGS. 3A and 3B, the dust collecting blade BL of the cleaning robot of FIG. 2 is configured such that in a normal mode, its bottom edge is angled toward the direction of travel of the cleaning robot as illustrated in FIG. 3A in order to facilitate the collection of dust and other debris into the dust box. However, as illustrated in FIG. 3B, when the bottom edge of the dust collecting blade BL encounters bumps or gaps in the ground surface GRD, the bottom edge of the dust collecting blade BL may be bent in a direction opposite to the direction of travel of the cleaning robot due to the elasticity of the dust collecting blade BL poor operation the cleaning robot as discussed above.

Because the dust collecting blade BL is made of an elastic material, it will tend to restore to its original shape after being bent. The bars br formed on the rear surface of the dust collecting blade BL will also tend to restore the bent dust collecting blade BL. However, through continued bending over time, the ability of the dust collecting blade BL to revert back to its original shape may be diminished due to the overall shape and structure of the dust collecting blade BL. Further, over time, the bottom edge of the dust collecting blade BL may become worn by rubbing against the ground surface GRD, thereby creating a gap between the bottom edge of the dust collecting blade BL and the ground surface GRD, thereby reducing the cleaning robot's effectiveness.

SUMMARY OF THE INVENTION

The present invention has been made in an effort to provide a cleaning robot having an improved driving and cleaning ability by suppressing wobbling of a dust collecting blade.

According to an aspect of the present invention, a cleaning robot includes: a frame which configures an outer appearance as a main body of the cleaning robot; a rotary brush which rotates by a driver provided in the main body of the cleaning robot to collect trashes; a dust box in which the trashes collected by the rotary brush are stored; and a dust collector which guides the trashes collected by the rotary brush to the dust box, in which the dust collector includes a dust collecting blade which guides the trashes collected by the rotary brush to the dust box and has a lower end bent in a direction opposite to a driving direction during the driving of the cleaning robot; a bracket which supports a rear surface of the dust collecting blade; and a coupler which fixes the dust collecting blade and the bracket to one of the frame and the dust box.

The bracket may be formed to support a part of an area of the rear surface of the dust collecting blade with respect to the traveling direction of the cleaning robot such that a lower end of the dust collecting blade is bend to a direction opposite to the traveling direction of the cleaning robot with a predetermined angle, thereby maintaining a shape of the dust collecting blade.

The bracket may support a rear upper end and a rear center area of the dust collecting blade in a horizontal direction to maintain the upper end of the dust collecting blade in the traveling direction of the cleaning robot during the driving and stopping of the cleaning robot and maintain the lower end of the dust collecting blade to be bent in a direction opposite to the traveling direction of the cleaning robot during the driving of the cleaning robot.

The dust collecting blade may be implemented by a material having elasticity to be easily bent in a direction opposite to the driving direction during the driving of the cleaning robot, and is fixed to the bracket.

When the cleaning robot stops, the dust collecting blade may be restored to a state before the cleaning robot is driven by a restoring force.

In the dust cleaning blade, a plurality of semicircular bars which is spaced apart from each other on a rear surface with a predetermined interval may be formed to increase the restoring force.

The plurality of semicircular bars may be formed to have smaller sizes toward the lower end of the dust collecting blade.

The coupler may be implemented by an elastic material so as to apply a pressure to the bracket toward the ground surface so that a lower end of the dust collecting blade is closely attached onto the ground surface even though the lower end of the dust collecting blade is worn by friction with the ground surface.

The rotary brush may include a plurality of first brushes formed by a group of fibers each having a length which reaches the lower end of the dust collecting blade to sweep the trashes collected at the lower end of the dust collecting blade bent in a direction opposite to the traveling direction into the dust box by a physical force; and a plurality of second brushes formed by a group of a plurality of fibers each having a length which reaches the ground surface to collect the trash at the lower end of the dust collecting blade.

In the rotary brush, the plurality of first brushes and the plurality of second brushes may be alternately disposed in rows.

The plurality of first brushes and the plurality of second brushes which are disposed in rows may be disposed in V shaped rows.

Each of the plurality of first brushes may further include a plurality of fibers having a length which reaches the ground surface to form a group at a predetermined ratio with the plurality of fibers having a length which reaches the lower end of the dust collecting blade.

The plurality of first brushes may be formed of a material having a larger wear resistance and a smaller elasticity than that of the plurality of second brushes. The cleaning robot may further include a rib which is implemented by an elastic material and is fixed to the frame and implemented as a blade having a length which interferes with the plurality of first brushes and the plurality of second brushes.

Therefore, according to the present invention, in the cleaning robot having an improved driving and cleaning ability, the lower end of the dust collecting blade is bent to a direction opposite to the driving direction during the driving of the cleaning robot, so that wobble is not generated even though the lower end of the dust collecting blade passes bumps or gaps on the ground surface and the driving resistance force is reduced, thereby improving the driving ability of the cleaning robot and preventing the noise and the malfunction. Further, the lengths of the plurality of brushes provided in the rotary brush are adjusted to easily sweep the dusts and trashes collected at the bent lower end of the dust collecting blade into the dust box, thereby improving the cleaning ability.

Furthermore, the bracket which supports a rear end of the dust collecting blade is provided to constantly maintain the shape of the dust collecting blade as long as possible. The dust collecting blade is fixed to the bracket which supports a rear surface thereof and the bracket is fixed to the frame or the dust box of the cleaning robot using an elastic material such as a spring. Therefore, even though the dust collecting blade is worn by the friction with the ground surface, the closely adhered state with the ground surface may be maintained by the pressure which is applied from the coupler.

The cleaning robot further includes a rib which dusts off the dusts attached onto the brush of the rotary brush so that the brush may be maintained to be clean, thereby improving the cleaning ability.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 illustrates an example of a structure of a rotary brush and a dust collecting blade of a conventional cleaning robot.

FIG. 2 illustrates another example of a dust collecting blade of another cleaning robot.

FIGS. 3A and 3B illustrate the dust collecting blade of FIG. 2 during operation of the cleaning robot.

FIG. 4 illustrates a structure of a rotary brush and a dust collecting blade of a cleaning robot according to an exemplary embodiment of the present invention.

FIG. 5 illustrates the rotary brush of FIG. 4.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

In order to sufficiently understand the present invention, the operational advantages of the present invention, and the objectives achieved by the embodiments of the present invention, the accompanying drawings illustrating preferred embodiments of the present invention and the contents described therein need to be referred to.

Hereinafter, the present invention will be described in detail by explaining preferred embodiments of the present invention with reference to the accompanying drawings. However, the present invention can be realized in various different forms, and is not limited to the exemplary embodiments described herein. In order to clearly describe the present invention, a part that may obscure the present invention may be omitted and like reference numerals denote like components.

Throughout the specification, unless explicitly described to the contrary, the word "comprise" and variations, such as "comprises" or "comprising", will be understood to imply the inclusion of stated elements but not the exclusion of any other elements. In addition, the terms "unit", "-er", "-or", "module", and "block" described in the specification mean units for processing at least one function and operation and can be implemented by hardware components or software components and combinations thereof.

FIG. 4 illustrates a cleaning robot according to an exemplary embodiment of the present invention.

Referring to FIG. 4, a cleaning robot according to an exemplary embodiment of the present invention includes a frame FR, which constructs a main body of the cleaning robot, a rotary brush RBU, which is rotated by a driver (not illustrated), such as a motor, to collect dusts and other debris, a dust box DST in which the dusts and other debris collected by the rotary brush RBU is stored, and a dust collector which guides the dusts and other debris collected by the rotary brush RBU to the dust box DST.

The dust collector includes a dust collecting blade BL, which guides dust and other debris, collected by the rotary brush RBU, to the dust box DST, a bracket BK, which supports the dust collecting blade BL, and a coupler SP which secures the bracket BK to either the frame FR or the dust box DST.

In the exemplary embodiment of the present invention, similar to the dust collecting blade of the cleaning robot illustrated in FIG. 1, the dust collecting blade BL may be angled towards the direction of travel of the cleaning robot, that is, angled towards the rotary brush RBU and the dust collecting blade BL may be formed of an elastic material. Therefore, when the cleaning robot is traveling, even though obstacles such as bumps or gaps are not presenting in the ground surface GRD, the lower end of the dust collecting blade BL is easily bent in the direction opposite the direction of travel of the cleaning robot due to friction between the bottom edge of the dust collecting blade BL and the ground surface GRD. Thus, when the cleaning robot is being driven, the lower end of the dust collecting blade BL is bent in a direction opposite to the driving direction of the cleaning robot. Therefore, even though obstacles such as bumps or gaps are presenting in the ground surface GRD during the driving of the cleaning robot, the dust collecting blade BL of the cleaning robot of the exemplary embodiment of the present invention is not stuck by the obstacles. Therefore, the problems in that the wobbling is generated during the driving of the cleaning robot or the dust collecting blade BL is stuck by the gap is suppressed, so that a possibility of a noise or a malfunction of the cleaning robot is significantly reduced. Further, the friction between the dust collecting blade BL and the ground surface GRD is reduced, thereby improving the drivability of the cleaning robot.

It has been described above that only during the driving of the cleaning robot, the lower end of the dust collecting blade BL is bent in a direction opposite to the driving direction of the cleaning robot. However, in an alternative embodiment, the lower end of the dust collecting blade BL may be bent in the direction opposite to the driving direction of the cleaning robot even when the cleaning robot is stationary, that is, when friction is not generated between the dust collecting blade BL and the ground surface GRD.

Further, as illustrated in FIGS. 3A and 3B, in yet another embodiment, a bar br may be provided on a rear surface of the dust collecting blade BL to improve its restoring force.

In the meantime, when the lower end of the dust collecting blade BL is bent in the direction opposite to the driving direction of the cleaning robot, as described above, the driving performance is improved. However, an ability of guiding dust or other debris collected by the rotary brush BRU is reduced. Specifically, when the dust collecting blade BL is formed of an easily bendable material, the above-mentioned problem becomes more serious. When the restoring force of the dust collecting blade BL is reduced, the cleaning ability of the cleaning robot is significantly reduced.

Therefore, in order to supplement the above-mentioned problem, the cleaning robot of the exemplary embodiment includes a bracket BK on a rear surface of the dust collecting blade BL, that is, a surface of the dust collecting blade BL opposite to the driving direction of the cleaning robot. Preferably, the bracket BK is disposed on the rear surface of the dust collecting blade BL to limit a range in which the dust collecting blade BL is bendable, thereby preventing the dust collecting blade BL from being excessively bent and maintaining a range through which is may be bent to be within a predetermined angle. Further, the reduction of the restoring force of the dust collecting blade BL is prevented. However, as described above, the purpose of the bracket BK is to maintain the dust collecting blade BL to be bent at a predetermined amount and suppress the restoring ability from being reduced. Therefore, the lower end of the dust collecting blade BL needs to be bent in a direction opposite to the driving direction during the driving of the cleaning robot. Therefore, as illustrated in FIG. 4, the bracket BK is preferably disposed only in a partial area of the rear surface of the dust collecting blade BL to support the dust collecting blade BL and the lower end of the dust collecting blade BL needs to be configured to be bent. Further, an upper end of the dust collecting blade BL is preferably fixed to the bracket BK so that the bracket BK supports only a designated position of the dust collecting blade BL. In FIG. 4, even though it is illustrated that a rear upper end and a rear center area of the dust collecting blade BL are fixed to the bracket BK, the center area of the dust collecting blade BL may not be fixed to the bracket BK.

The coupler SP not only secures the dust collecting blade BL and the bracket BK to the cleaning robot, but also prevents a gap from being developed between the dust collecting blade BL and the ground surface GRD even though the dust collecting blade BL may be worn by the friction with the ground surface GRD. In the present invention, the coupler SP includes an elastic material, such as a spring illustrated in FIG. 4, to apply a pressure to the dust collecting blade BL in the direction toward the ground surface GRD. By doing this, even though the dust collecting blade BL is worn by the friction, the dust collecting blade may be urged into contact with the ground surface GRD. However, as described above, in the exemplary embodiment of the present invention, the dust collecting blade BL is fixed to the bracket BK. Therefore, the coupler SP does not directly apply pressure to the dust collecting blade BL, but applies pressure to the bracket BK, which, in turn, applies pressure to the dust collecting blade BL.

One end of the coupler SP may be fixed to the bracket BK and the other end may be fixed to a main body of the cleaning robot. However, since the purpose of the dust collector is to guide the dust or debris collected by the rotary brush RBU to the dust box DST, the other end of the coupler may be fixed to the dust box DST.

As described above, the rotary brush RBU collects dust and other debris and may include a plurality of brushes. For the purpose of cleaning efficiency, the rotary brush RBU is generally configured such that a plurality of brushes are disposed in rows. The rotary brush RBU of FIG. 1 is configured such that the plurality of brushes disposed in rows all have the same length. However, the rotary brush RBU of the exemplary embodiment of the present invention is configured such that the plurality of brushes may have different lengths as illustrated in FIG. 4. The reason is to suppress the cleaning ability from being reduced, even though the lower end of the dust collecting blade BL in the cleaning robot is bent in the direction opposite to the driving direction during the driving of the cleaning robot.

In the cleaning robot of FIG. 2, the lower end of the dust collecting blade BL is disposed toward the rotary brush RBU, so that the plurality of brushes of the rotary brush RBU simply sweep the collected dusts and other debris to the dust collecting blade BL and a distance therebetween is small. Therefore, the plurality of brushes may have a uniform length which reaches the ground surface GRD. However, as illustrated in FIG. 4, in the cleaning robot according to the exemplary embodiment of the present invention, the lower end of the dust collecting blade BL is bent in a direction opposite to a direction in which the rotary brush BRU is disposed. Therefore, it is difficult to sweep dust or other debris collected at the lower end of the dust collecting blade BL with the length of the plurality of brushes provided in the rotary brush RBU of FIG. 2. However, the above-mentioned problem may be solved by increasing the length of the plurality of brushes to reach the lower end of the dust collecting blade BL. That is, the dust or other debris collected at the lower end of the dust collecting blade BL is swept upwards by the plurality of brushes of the rotary brush RBU.

However, when the length of the plurality of brushes is increased, the interference with the frame FR is increased due to the increased length of the brush, which may apply a large load to the rotation of the rotary brush RBU. Further, the entire cleaning robot is not closely attached onto the ground surface GRD but may be floated, due to the elasticity of the plurality of brushes. When the cleaning robot is not closely attached onto the ground surface GRD, the driving performance of the cleaning robot is reduced and the cleaning performance may also be significantly reduced.

Therefore, as illustrated in FIG. 4, in the cleaning robot according to the exemplary embodiment of the present invention, not all of the brushes are equally increased in their lengths, but some of the brushes are longer than the others (for example, 1 cm longer than the others) The brushes having a longer length and brushes having a shorter length are preferably alternately disposed in rows or rows of the brushes having a large length are disposed with a predetermined interval (for example, one row of brushes having a longer length is disposed after three rows of brushes having a shorter length), thereby minimizing the above-described problem.

A rib LB is fixed to one of the frame FR and the dust box DST and has a length to interfere with the plurality of brushes of the rotary brush RBU. In this case, the rib LB may be implemented as a bar or blade having a length and a width which reaches the brush having a small length so as to interfere with all the plurality of brushes. The rib LB dusts off dust and other debris attached onto the plurality of brushes but are not swept into the dust box DST so that the plurality of brushes may be maintained to be clean. The rib LB is desirably implemented by a material and a structure which cause low friction, thereby suppressing the overload of the rotation of the rotary brush RBU or wear and tear of the brushes caused by the interference of the plurality of brushes.

As a result, in the cleaning robot according to the exemplary embodiment of the present invention, the lower end of the dust collecting blade BL is bent in the direction opposite to the driving direction during the driving of the cleaning robot, so that the wobbling is not generated even when the lower end of the dust collecting blade BL passes bumps or gaps of the ground surface GRD. Further, driving resistance force is reduced to improve the driving ability of the cleaning robot and suppress a noise and a malfunction. Further, the lengths of the plurality of brushes provided in the rotary brush RBU are adjusted to easily sweep dust and other debris collected at the bent lower end of the dust collecting blade BL into the dust box DST, thereby improving the cleaning performance of the cleaning robot.

Furthermore, the bracket BK which supports a rear end of the dust collecting blade BL is provided to constantly maintain the shape and the restoring force of the dust collecting blade BL for as long as possible. The dust collecting blade BL is fixed to the bracket BK which supports a rear surface of the dust collecting blade BL and the bracket BK is fixed to the frame FR or the dust box DST of the cleaning robot via the coupler SP having elasticity, such as a spring. Therefore, even if the dust collecting blade BL is worn by the friction with the ground surface GRD, a closely adhered state with the ground surface GRD may be maintained by the pressure which is applied from the coupler SP.

Additionally, the plurality of brushes of the rotary brush RBU may have different lengths and the rib which dusts off the dust attached onto the brushes to improve the cleaning ability.

For the convenience of description, the structures of the rotary brush RBU and the dust collecting blade BL of the cleaning robot have been mainly described with reference to FIG. 4. However, it is obvious that the cleaning robot according to the exemplary embodiment of the present invention may further include components such as wheels to allow the cleaning robot to travel and a controller which controls an operation of the cleaning robot, similar to the conventional cleaning robot.

FIG. 5 is a view specifically illustrating a rotary brush of FIG. 4.

The rotary brush RBU in FIG. 5 is implemented to have a cylindrical shape to be easily rotated by a driving unit (not shown) and includes a plurality of brushes BS1 and BS2. Further, each of the plurality of brushes BS1 and BS2 is configured by a group of a plurality of fibers.

In the exemplary embodiment of the present invention, the plurality of brushes BS1 and BS2 is configured by a plurality of first brushes BS1 and a plurality of second brushes BS2 which have different lengths. That is, lengths of the plurality of fibers which configure the first brushes BS1 are different from lengths of the plurality of fibers which configure the second brushes BS.

The plurality of second brushes BS2 have the same length as the brushes of the conventional cleaning robot in FIG. 2 which reaches the ground surface GRD to transfer the dusts and other debris on the ground surface GRD to the dust collecting blade BL.

In contrast, the plurality of first brushes BS1 have lengths which may reach the bottom edge of the dust collecting blade BL in FIG. 4. This is because the lower end of the dust collecting blade BL in the cleaning robot according to the exemplary embodiment of the present invention is bent to the direction opposite to the driving direction of the cleaning robot, as described above so that the plurality of first brushes BS1 of the rotary brush RBU need to sweep up the dusts and other debris collected at the lower end of the dust collecting blade BL by a driving force. Further, in order to reduce the interference with the frame FR caused by the increased length of the plurality of first brushes BS1, the plurality of first brushes BS1 and the plurality of brushes BS2 may be alternately disposed in rows, as illustrated in FIG. 4.

Further, as illustrated in FIG. 5, not all the plurality of fibers which configures the first brushes BS1 has a length to reach the bottom edge of the dust collecting blade BL, but only some of fibers have the length to reach the bottom edge of the dust collecting blade BL and the other fibers reach the ground surface GRD, thereby further reducing the interference with the frame FR. In this case, a ratio of the long fibers to the short fibers may be adjusted by a designer of a particular cleaning robot.

The plurality of first brushes BS1 and the plurality of second brushes BD2, which are alternately disposed in rows as described above, may be disposed, in an alternative embodiment, in a straight line in rows. In order to improve the dust collecting performance or the cleaning performance, the plurality of first brushes BS1 and the plurality of second brushes BS2 may be disposed in rows to form a V shape as illustrated in FIG. 5. That is, first and second brushes BS1 and BS2 which are disposed towards edges of the rotary brush RBU initially collect the dusts and other debris, and first and second brushes, which are disposed towards the center collect the dust and other debris later. By doing this, the dusts and other debris collected by the rotary brush RBU are not scattered towards sides of the cleaning robot but collected towards a lower center area of the dust collecting blade BL to improve the cleaning ability of the cleaning robot.

The plurality of first brushes BS1 and the plurality of second brushes BS2 may be implemented by the same material. However, when the plurality of first brushes BS1 and the plurality of second brushes BS2 are composed of the same material, the plurality of first brushes BS1 which are longer than the plurality of second brushes BS2 have relatively large friction with the ground surface GRD, so that the plurality of first brushes BS1 may be worn faster than the plurality of second brushes BS2. This may shorten the lifespan of the rotary brush RBU. Therefore, the plurality of first brushes BS1 may be composed of a material having higher wear resistance than that of the plurality of second brushes BS2.

Further, since the plurality of second brushes BS2 has a length to reach the ground surface GRD, the second brush may increase the cleaning efficiency without impeding the driving of the cleaning robot. However, since the plurality of first brushes BS1 is longer than the plurality of second brushes BS2, when the plurality of first brushes is formed of a material having high elasticity, as described above, the entire cleaning robot is not in close contact to the ground surface GRD but is floated by the elasticity of the plurality of brushes. Therefore, the plurality of first brushes BS1 may be composed of a material having a lower elasticity and higher flexibility than those of the plurality of second brushes BS2.

A method according to the exemplary embodiment of the present invention can be implemented as a computer-readable code in a computer-readable recording medium. The computer readable recording medium includes all types of recording device in which data readable by a computer system is stored. Examples of the recording medium are ROM, RAM, CD-ROM, a magnetic tape, a floppy disk, an optical data storing device. The computer readable recording medium is distributed in computer systems connected through a network and a computer readable code is stored therein and executed in a distributed manner.

The present invention has been described with reference to the exemplary embodiment illustrated in the drawing, but the exemplary embodiment is only illustrative, and it would be appreciated by those skilled in the art that various modifications and equivalent exemplary embodiments may be made.

Accordingly, the actual scope of the present invention must be determined by the technical spirit of the appended claims.

What is claimed is:

1. A cleaning robot comprising:

a frame;

a rotary brush;

a dust box;

a dust collecting blade positioned to guide debris collected by the rotary brush to the dust box, the dust collecting blade extending from the dust box toward the rotary brush and including a lower portion that is bent away from the rotary brush and in a direction opposite to a driving direction of the cleaning robot at least when the cleaning robot is moving in the driving direction;

a bracket supporting a rear surface of the dust collecting blade at a portion of the dust collecting blade at which the lower portion of the dust collecting blade is bent; and a coupler securing the dust collecting blade and the bracket to at least one of the frame and the dust box.

2. The cleaning robot of claim 1, wherein the bracket restricts an angular movement of the lower portion of the blade about the portion of the dust collecting blade at which the lower portion of the dust collecting blade is bent.

3. The cleaning robot of claim 1, wherein the bracket maintains an orientation of an upper portion of the dust collecting blade in the driving direction of the cleaning robot when the cleaning robot is moving in the driving direction.

4. The cleaning robot of claim 1, wherein the dust collecting blade comprises an elastic material.

5. The cleaning robot of claim 1, wherein the lower portion of the dust collecting blade is bent away from the rotary brush and in the direction opposite to the driving direction of the cleaning robot when the cleaning robot is moving in the driving direction and when the cleaning robot is stationary.

6. The cleaning robot of claim 1, further comprising one or more bars provided on a rear surface of the dust cleaning blade to increase a restoring force of the dust cleaning blade.

7. The cleaning robot of claim 6, wherein each of the at least one bars has a semicircular shape.

8. The cleaning robot of claim 1, wherein the coupler comprises an elastic material that cooperates with the bracket to urge the dust collecting blade towards a ground surface.

9. The cleaning robot of claim 1, wherein the rotary brush includes a plurality of fibers of differing lengths.

10. The cleaning robot of claim 1, wherein the rotary brush includes a plurality of brushes arranged in rows, each of the plurality of brushes including a plurality of fibers of differing lengths.

11. The cleaning robot of claim 1, wherein the rotary brush comprises a plurality of brushes arranged in V shaped rows, each of the plurality of brushes including a plurality of fibers of differing lengths.

12. The cleaning robot of claim 1, wherein the rotary brush comprises a plurality of brushes, each of the plurality of brushes including fibers having a first length which extends from a surface of the rotary brush to a ground surface and fibers having a second length which extends from the surface of the rotary brush to a bottom edge of the dust collecting blade.

13. The cleaning robot of claim 1, wherein the rotary brush comprises a plurality of fibers formed of a first material and a plurality of fibers formed of a second material, wherein the first material is more wear resistant and less elastic than the second material.

14. The cleaning robot of claim 1, wherein the rotary brush includes fibers of different lengths and wherein the cleaning robot further comprises an elastic rib sized and positioned to interfere with each of the fibers as the rotary brush rotates.

15. The cleaning robot of claim 1, further comprising a plurality of bars provided on a rear surface of the dust cleaning blade to increase a restoring force of the dust cleaning blade, wherein sizes of the plurality of bars decrease toward the lower portion of the dust cleaning blade.

* * * * *